US005799552A

United States Patent [19]

Curtis

[11] Patent Number: 5,799,552

[45] Date of Patent: Sep. 1, 1998

[54] 13 IN 1 MULTI-PURPOSE SCREWDRIVER

[76] Inventor: Dennis Francis Curtis, 952 Humbolt Ct., San Dimas, Calif. 91773

[21] Appl. No.: 801,789

[22] Filed: Feb. 18, 1997

[51] Int. Cl.[6] ..... B25G 1/08

[52] U.S. Cl. ..... 81/490; 81/177.4; 81/438

[58] Field of Search ..... 81/490, 177.4, 81/437, 438, 439

[56] References Cited

U.S. PATENT DOCUMENTS

| | | | |
|---|---|---|---|
| 2,629,413 | 2/1953 | Stettler | 81/490 |
| 4,278,119 | 7/1981 | Elmore | 81/490 |
| 4,449,559 | 5/1984 | Martinmaas | 81/177.4 |
| 4,924,733 | 5/1990 | McKenzie | 81/490 |
| 5,265,504 | 11/1993 | Fruhm | 81/490 |
| 5,499,562 | 3/1996 | Feng | 81/490 |

FOREIGN PATENT DOCUMENTS

| | | | |
|---|---|---|---|
| 312775 | 4/1989 | European Pat. Off. | 81/490 |
| 3004958 | 8/1981 | Germany | 81/439 |

*Primary Examiner*—Eileen P. Morgan
*Assistant Examiner*—Joni B. Danganan

[57] ABSTRACT

A screwdriver with sturdy construction, lightweight, changes quickly, and transports easily. This device has a two deck multi-bit holder for nut drivers and bits, a top locking deck which is very secure, a quick release button to separate the decks and observe the nut drivers and bits, a hand driver with a magnetic sleeve to accept all the nut drivers and bits, and a hex to slide the top deck up and down. The key to this device lies in the top lock deck: the notched dowel pin fits snuggly into the matching notch on the hex shaft.

1 Claim, 2 Drawing Sheets

13 IN 1 MULTI-PURPOSE SCREWDRIVER

BACKGROUND OF THE INVENTION

1. Field of the Invention

The present invention relates in general to screwdrivers, and in particular to multi-purpose screwdrivers, using nut drivers, phillips bits and straight slot bits.

2. Prior Art

Many workers: electricians, air conditioning repairmen and women, and many technological fields of the workforce, have faced the problem of carrying many different tools to complete a job. In the past, many of the tools have been heavy and had to be carried up and down ladders, risking the worker falling off.

U.S. Pat. No. 5442982, "Nesting Pocket Screwdrivers" were invented, using a slotted tip and a phillips tip to help minimize the weight of carrying tools and become more efficient on the job. U.S. Pat. No. 546063, "Combination Hand Tool", combines a screwdriver and a nut driver.

No device is known, however, combining both nut drivers, phillips bits and straight slot bits. With the previous devices they are still inadequate. Still at least five pounds of extra weight are to be carried around.

SUMMARY OF THE INVENTION

The principal object of my present invention is to provide a device for use in carrying out my work in the most efficient and safest manner as possible. I, Dennis F. Curtis, have discovered the solution of combining nut drivers, phillips bits, and straight slot bits into one screwdriver.

It also is an object of the present invention to provide such a device which is simple with sturdy construction.

Another object is to provide such a device in lightweight form that can be changed quickly, and be easy to transport to the jobsite in a pocket.

A further object is to provide such a device which, in use, will decrease the fear of workers climbing ladders with heavy equipment.

Here is how my remarkable invention works: The foregoing objects can be accomplished by providing a multi-purpose 13 in 1 device. It contains nut drivers: 3/16", 1/4", 5/32", 5/16", 11/32", 3/8", and 7/16"; 3 phillips bits: sizes 1, 2, and 3; and 3 straight slot bits: sizes 4, 6, and 8.

This device has two decks. This device has a special feature of a locking deck to prevent the nut drivers and screwdriver bits from falling out. Also, the locking deck has a special feature of being locked in place by just the push of a button.

The screwdriver bits are seated in the screwdriver handle itself. The nut drivers are in a movable platform which slide up and down the hexagon shaft of the screwdriver. The device has a permanent nut driver sleeve attached to the end of the hexagon shaft, which accepts all 12 of the other nut drivers and screwdriver bits, which all have 1/4" shanks.

This device gives more choices, works faster and more efficiently. All the nut drivers and bits can be used in any drill motor, as well as screwdriver, which makes it possible to carry less equipment around.

This device will be the only one on the market containing nut drivers, phillips bits and straight slot bits. It has easy access. You can look at the whole device in an instant to make your choice quickly and efficiently. The nut drivers and bits will not fall out.

As a reward for my contribution, I claim the rights to my 13 in 1 multi-purpose screwdriver:

DETAILED DESCRIPTION

Figure 1:
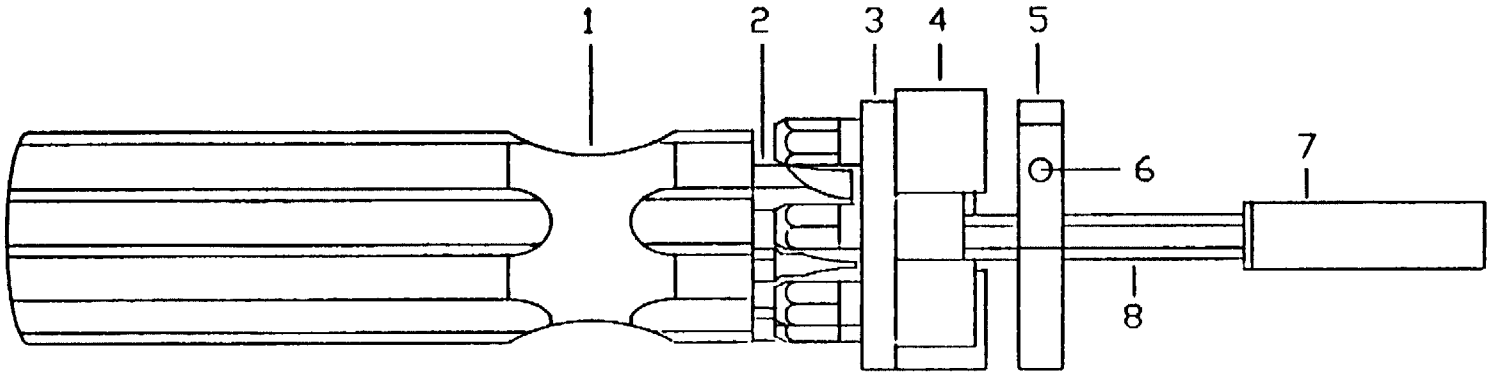
FIG. 1 is a side closed view of the device in accordance with the present invention.

As shown in the drawings, the preferred screwdriver device in accordance with the present invention includes a two deck multi-bit and nut driver holder that is portable in a screwdriver style. The device is hexagon shaped, which is of strong molded plastic material with metal inserts, consisting of nut driver and screwdriver bits.

Figure 2:
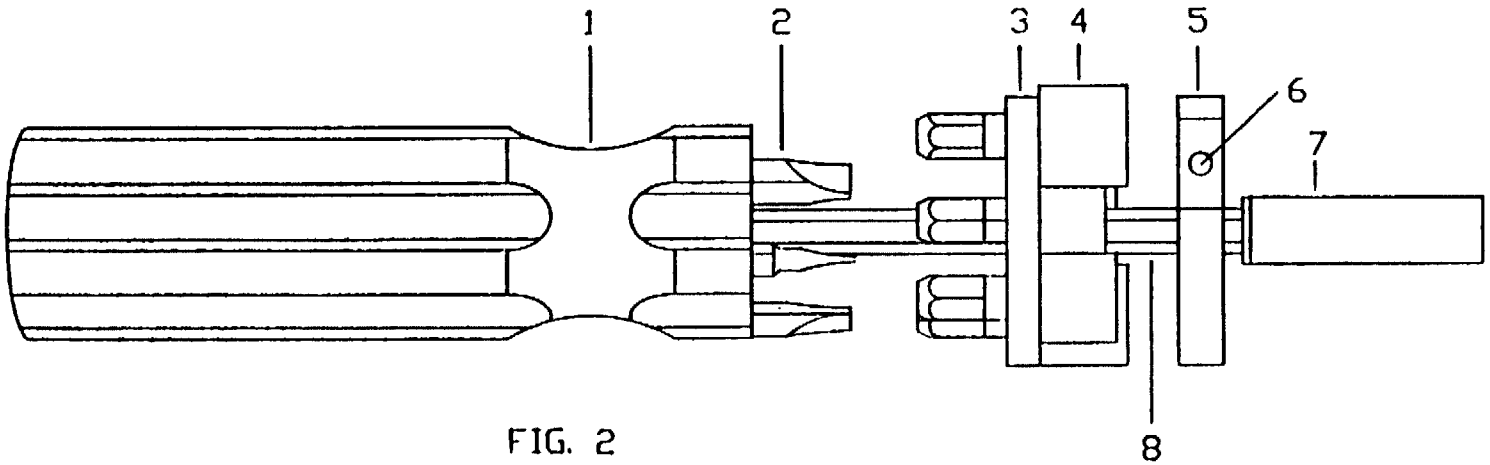
FIG. 2 is a side view of the device separated.

With reference now to the FIGURES wherein like reference characters designate like or similar parts throughout FIG. 1 and FIG. 2 views. FIG. 1 is an overall drawing of a preferred embodiment of the invention. FIG. 1 is a side closed view of the device in accordance with the present invention. This multi-purpose screwdriver has a heavy grip handle (1) with six round holes at the top to hold the hex bits. The handle holds (2) the phillips bits sizes 1, 2, and 3, and the straight slot bits sizes 4, 6, and 8.

With reference to the second deck (3), which is of delrin material, having seven holes: one in the center for the hex shank to go through, the remaining six round holes to fit the six 1/4" hex nut drivers (4): 3/16", 5/32", 11/32", 3/8", and 7/16".

The top deck (5) slides to the sleeve and to the handle. When toward the handle, it is closed. When toward the sleeve, it is open. When towards sleeve, you can quickly change the nut drivers and bits. When towards the handle the top deck securely holds all parts of this screw-driver together.

The quick release button (6) enables you to separate the two decks. One can observe the nut drivers in the top deck and slide the deck to also observe the second deck bits. There is no rotation in the screwdriver, enabling all the pieces to stay secure.

The magnetic sleeve (7) is 1/4" hex hand driver, which accepts all the nut drivers and bits.

The hex shaft (8), which fits into the handle and holds the second deck, as well as the sleeve.

FIG. 2 is a side view of the device separated. This picture shows how you can easily touch the quick release button (6), separate the decks to change whatever bit or nut driver needed. The numbers in FIG. 2 are kept in order the same as FIG. 1: the handle (1), the bits (2), the second deck (3), the nut drivers (4), the quick release button (6), the sleeve (7), and the hex shaft (8).

With reference now to FIGURES wherein like reference characters designate like or similar parts throughout FIG. 3 through 6 views.

Figure 3:
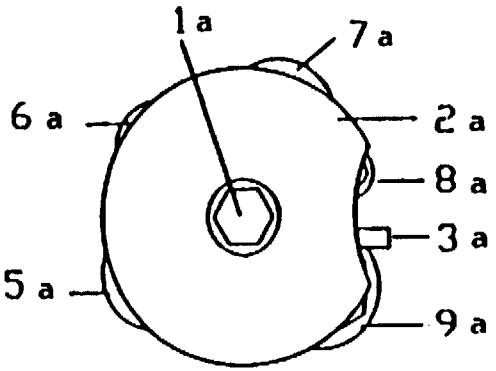
FIG. 3 is a right side view of the device.

FIG. 3 is a right side view of the device. (5*a*), (6*a*), (7*a*), (8*a*), and (9*a*) are five of the six nut drivers showing. The sixth nut driver runs flush with the top deck. (1*a*) is the center of the sleeve which is on the end of the hex shaft. The magnetic sleeve has a 1/4" center which is crucial. It accepts all the nut drivers and bits. (2*a*) is the top deck which slides up and down. (3*a*) is the quick release button.

Figure 4:
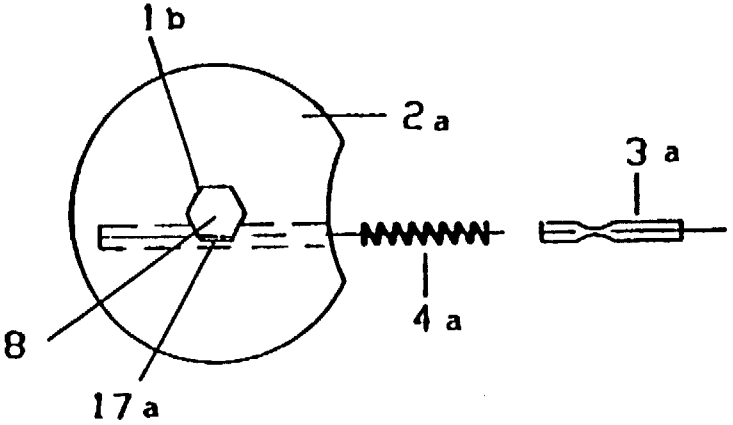
FIG. 4 is a cut away view of the top locking deck/locking disk.

FIG. 4 is a cut away view of the top locking deck. (1*b*) is the center where the hex shaft goes through the top locking deck. (2*a*) is the top locking deck, (3*a*) Is a notched dowel pin, (4*a*) is a spring, and (17*a*) is the mating notch on the hex shaft to lock onto the notched dowel pin. (3*a*), (4*a*), and (17*a*) are the key to the locking mechanism of this device.

Figure 5:
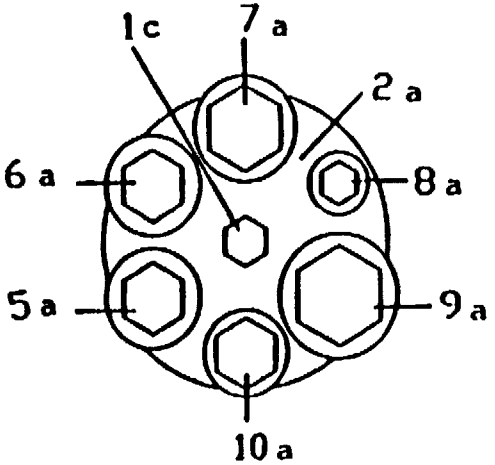
FIG. 5 is a right side view of the second deck/first disk of the device.

FIG. 5 is a side view of the second deck of this device. (5*a*), (6*a*), (7*a*), (8*a*), (9*a*), and (10*a*), show the six nut drivers in place, sizes 3/16", 5/32", 5/16"; 11/32", 3/8", and 7/16". (1*c*) is the center where the hex shaft goes through the second deck to hold the decks in place. (2) is the second deck.

Figure 6:
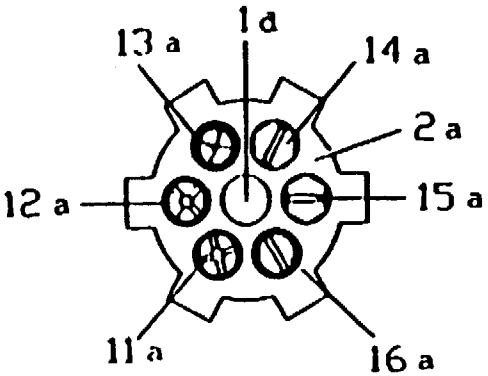
FIG. 6 is a right side view of the handle from the handle of the device.

FIG. 6 is the top view of the handle of the device. (11*a*), (12*a*), (13*a*), (14*a*), (15*a*), and (16*a*) show the bits. (11*a*), (12*d*), and (13*a*) are the phillips bits, sizes 1, 2, and 3. (14*a*), (15*a*), and (16*a*) are the straight slot bits, sizes 4, 6, and 8. (1*d*) is the center of the handle where the hex shaft goes through. (2*a*) is the top of the handle where the bits fit securely.

The thirteen tools used in this device are found in FIG. 3 (1) the ¼" hex magnetic hand driver, FIG. 5 the nut drivers (5*a*), (6*a*), (7*a*), (8*a*), (9*a*), and (10*a*), and FIG. 6 the phillips bits and straight slot bits (11*a*), (12*a*), (13*a*), (14*a*), (15*a*), and (16*a*).

This device is suitable for all levels of people, from the non-experienced person to the very experienced craftsman. The beginner handy person to carpenter, electrician on up. A big highlight of this device is that it transports easily, and fits in small places. All the parts of this invention work together to produce a very useful result.

The theory behind this invention was found for me while working as an electrical air conditioner/heater technician. Many times I had to climb ladders with many different tools, taking time going up and down the ladder with extra weight. Or, while in tight spots near high voltage electrical boxes, working by myself, it was vital I had my tools there the instant I needed them to prevent electrocution. I conceived this idea of my 13 in 1 multi-purpose screwdriver to be very safe and efficient in dealing with mechanical and electrical equipment.

The foregoing description of the preferred embodiment of the invention has been presented for the purposes of illustration and description. It is not intended to be exhaustive or to limit the invention to the precise form disclosed. Many modifications and variations are possible in light of the above teaching. It is not intended that the scope of this invention be limited not by this detailed description, but rather by the claim appended hereto.

I claim:

1. A compact multi-purpose screwdriver comprising:

a handle having a longitudinal axis and first and second ends, wherein the first handle end includes a plurality of bit-receiving bores arranged circumferentially about and parallel to the longitudinal axis;

a hexagonal shaft having a first end and a second end, wherein the first shaft end includes a magnetic sleeve for detachably engaging a tool bit, and the second shaft end is mounted to the first handle end through the longitudinal axis;

a first disk slidably mounted on the shaft, wherein the disk includes a plurality of nut driver-receiving bores arranged circumferentially about and parallel to the longitudinal axis;

a locking disk slidably mounted on the shaft between the first disk and the magnetic sleeve, wherein the locking disk has a cut-out portion with a small bore perpendicular to the longitudinal axis and through the cut-out portion, the bore including a spring and a notched quick release button for releasably engaging within a notch of the shaft, whereby movement of the button within the bore allows the locking disk to slide along the shaft, and return movement of the button to a normal position prevents sliding movement of the locking disk and the first disk; and a plurality of bits within the bit-receiving bores of the handle and a plurality of nut drivers within the nut driver-receiving bores of the disk.

* * * * *